US005377386A

United States Patent [19]

Griffith

[11] Patent Number: 5,377,386

[45] Date of Patent: Jan. 3, 1995

[54] QUICK-RELEASE DISCONNECT FOR A HARNESS

[75] Inventor: Richard R. Griffith, Utica, N.Y.

[73] Assignee: Sturges Manufacturing Company, Inc., Utica, N.Y.

[21] Appl. No.: 137,639

[22] Filed: Oct. 18, 1993

[51] Int. Cl.[6] ..... A44B 21/00; A45F 5/00

[52] U.S. Cl. ..... 24/3 B; 24/165; 24/197; 24/265 H; 224/904

[58] Field of Search ..... 24/3 B, 3 R, 3 M, 165, 24/196, 197, 200, 519, 265 H, 265 AL, 265 CD, 301, 302; 224/252, 904

[56] References Cited

U.S. PATENT DOCUMENTS 1,603,484 10/1926 Meissner ..... 24/197
1,697,833 1/1929 Lane ..... 24/197
2,549,841 4/1951 Morrow et al. ..... 24/197
4,670,945 6/1987 Banks ..... 24/197

*Primary Examiner*—Victor N. Sakran
*Attorney, Agent, or Firm*—Harris Beach & Wilcox

[57] ABSTRACT

A quick release disconnect for a harness comprising an attached pivotable collar that is pulled through gravitational force from a lock position of upward rotation into a normal release position of downward rotation. The pivotable collar in its lock position of upward rotation engages a yoke on a snaphook. A tang secures the pivotable collar in its lock position to the yoke. A flexible quick-release means detaches the from the pivotable collar such that the pivotable collar returns to its normal release position and the yoke is automatically disengaged from the pivotable collar.

6 Claims, 2 Drawing Sheets

QUICK-RELEASE DISCONNECT FOR A HARNESS

BACKGROUND OF THE INVENTION

1. Field of the Invention

This invention relates to a harness used to distribute the weight and, thus provide the operator with more comfort when operating equipment and in particular, to a quick-release mechanism for disconnecting the harness from the equipment.

2. Description of the Related Art

A harness provides weight distribution to the shoulder and arms, instead of the arms alone, and thus increases the comfort level for someone operating mechanical, electrical, or gas-powered equipment. For example, in order to keep the cutting end of a string trimmer distanced from its operator's lower extremities, a string trimmer's handle is positioned near the center of its shaft. The centered handle requires the operator to provide the needed labor to keep the cutting end positioned the proper distance from the ground. A shoulder harness provides support for the operator.

In a typical arrangement, a snaphook located at one end of a harness connects to a clasp on the equipment. On a string trimmer, the clasp is located above the string trimmer's centered handle. The harness is released when the operator depresses the proper segment on the snaphook and then disconnects the snaphook from the clasp.

However, mechanical, electrical or gas-powered equipment can malfunction. In gas-powered equipment, the fuel can ignite. In electrical equipment, the motors can overheat and burst into flames. In mechanical equipment, the gears can become obstructed. In such circumstances, the above-identified method would not release the equipment from the harness in a quick, safe and efficient manner.

In an attempt to solve the problem, prior art mechanisms utilize tangs and brackets. These require the operator to first pull on a release cord and then push the equipment off a holding bracket. The use of tangs and brackets, however, does not reduce the amount of time and effort the operator must expend to release the equipment from the harness.

SUMMARY OF THE INVENTION

It is therefore a primary object of the present invention to improve the mechanism for disconnecting harness.

A further object of the present invention is to provide a quick-release disconnect for a harness.

A still further object of the present invention is to improve the safe use of a harness.

A yet still further object of the present invention is to provide a cost-effective quick-release disconnect for a harness.

These and other objects of the present invention are attained by a quick release disconnect for a harness comprising an attached pivotable collar that is pulled through gravitational force from a lock position of upward rotation into a normal release position of downward rotation. The pivotable collar in its lock position of upward rotation engages a yoke on a snaphook. A tang secures the pivotable collar in its lock position to the yoke. A flexible quick-release means detaches the tang from the pivotable collar such that the pivotable collar returns to its normal release position and the yoke is automatically disengaged from the pivotable collar.

BRIEF DESCRIPTION OF THE DRAWING

For a better understanding of these and other objects of the present invention, reference is made to the detailed description of the invention which is to be read in conjunction with the following drawings, wherein.

DESCRIPTION OF THE PREFERRED EMBODIMENT

Figure 1:
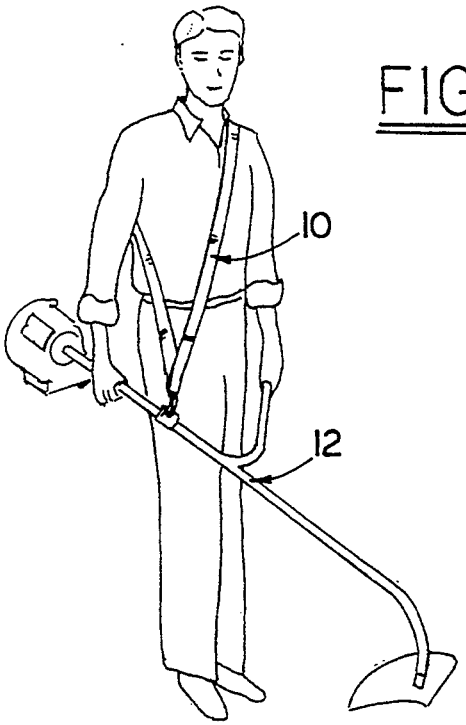
FIG. 1 is a view of the present invention as worn in operation with a string trimmer and a shoulder harness.

In FIG. 1, a shoulder harness 10, worn in a diagonal across the operator's chest, is attached to a string trimmer 12. The shoulder harness 10 increases the operator's comfort level when operating the string trimmer 12. In an attempt to solve the problem of quick, safe and efficient release of equipment such as the string trimmer 12 from a harness such as the shoulder harness 10, the prior art utilizes an arrangement of tangs and brackets.

Figure 2:
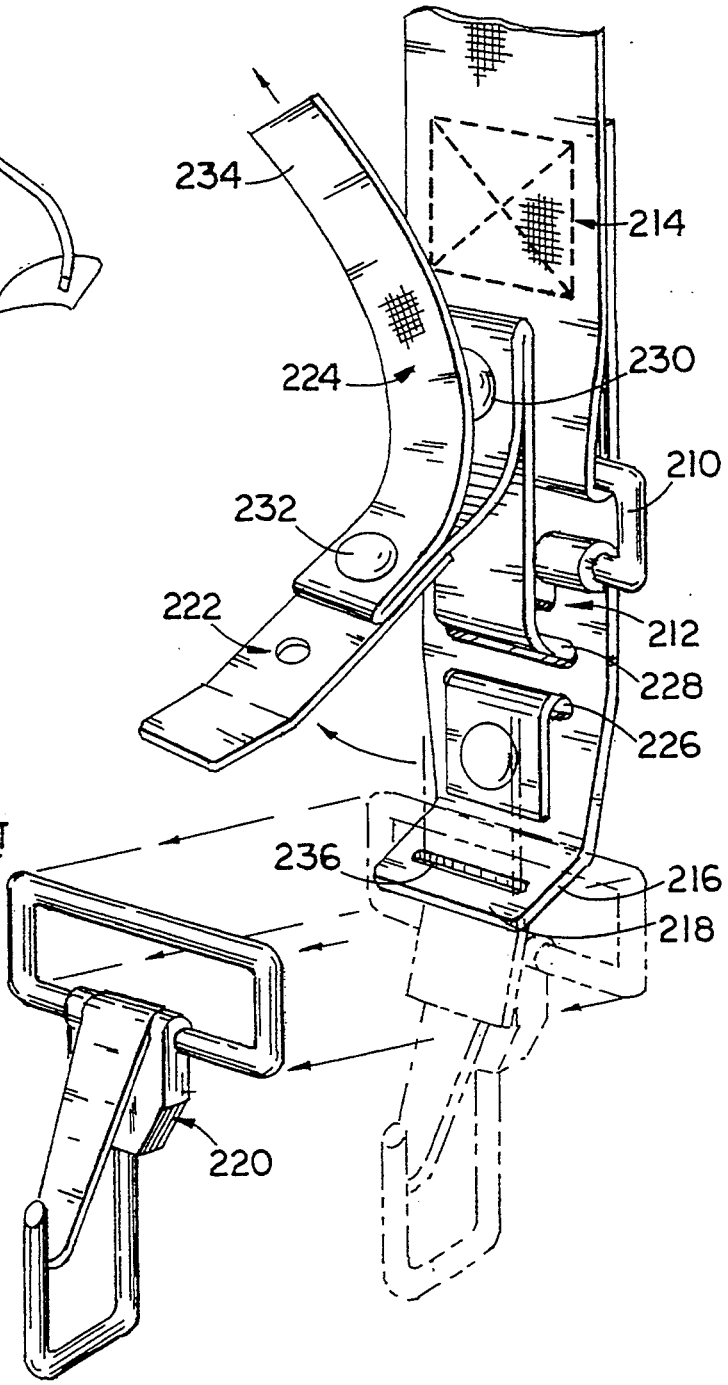
FIG. 2 PRIOR ART
FIG. 2 detailed view of the prior art showing the movement of a snaphook.

In FIG. 2, one such prior art arrangement uses a metal loop 210 to attach a rigid metal bracket 212 to the harness 214. The distal end 216 of the rigid metal bracket 212 angles up to form a holding shelf 218 for a detachable snaphook 220.

A metal tang 222 is attached to the rigid metal bracket 212 with a canvas cord 224 woven through a lower slot 226 and an upper slot 228 in the rigid metal bracket. The canvas cord 224 is folded back onto itself at two points, and both sewn and riveted into place at these two points. The first point 230 occurs where canvas cord 224 leaves the upper slot 228. The second point 232 occurs where the canvas cord 224 attaches to the metal tang 222.

During disconnection, the operator pulls the free end 234 of the canvas cord 224. As the canvas cord 224 is being pulled, the first point 230 presses against the harness 214 to form a backstop for the metal tang 222. As the operator continues to pull on the canvas cord 224, the metal tang 222 is lifted from an opening 236 in the holding shelf 218. Once the metal tang 222 has cleared the opening 236, the operator slides the detachable snaphook 220 off the holding shelf 218. At this point, the harness 214 is released from the equipment.

Figure 3:
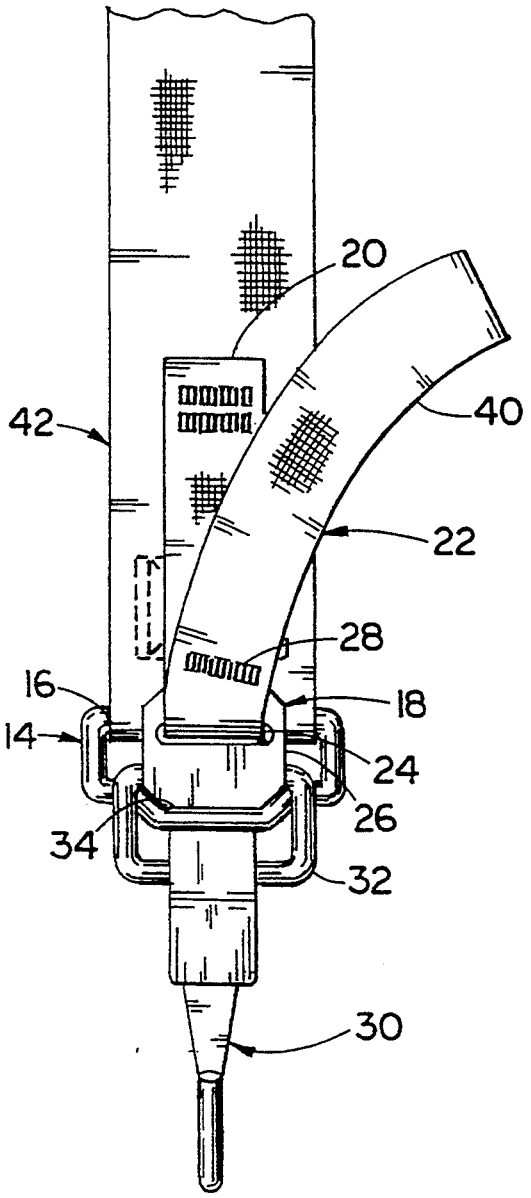
FIG. 3 is a detailed front view of the present invention with its tang securing a detachable snaphook to a harness.

In FIG. 3, in the present invention, a collar 14 is attached to a harness 42. The collar 14 pivots in a partial arc around a center axis 16 formed where the collar 14 attaches to the harness 42. In the present invention, the collar is constructed out of metal. In an alternate embodiment, the collar is constructed out of plastic.

A tang 18 is attached to the front face 20 of the harness 42 with a cord 22. The cord 22 is connected to the tang 18 through an opening 24 in the top portion 26 of the tang 18. At point 28, the cord 22 is folded over onto itself and secured into place. In the present invention, the cord 22 is sewn into place, the tang 18 is constructed out of metal, and the cord 22 is constructed out of canvas. In an alternate embodiment, the cord 22 is riveted into place, and the tang 18 and the cord 22 are constructed out of plastic.

In FIG. 3, the collar 14 is pivoted upward toward the front face 20 of the harness 42. In this lock position, the collar 14 is designed to engage the yoke 32 of the detachable snaphook 30. The tang 18 is inserted through the slot 34 created between the yoke 32 and the collar 14.

Figure 4:
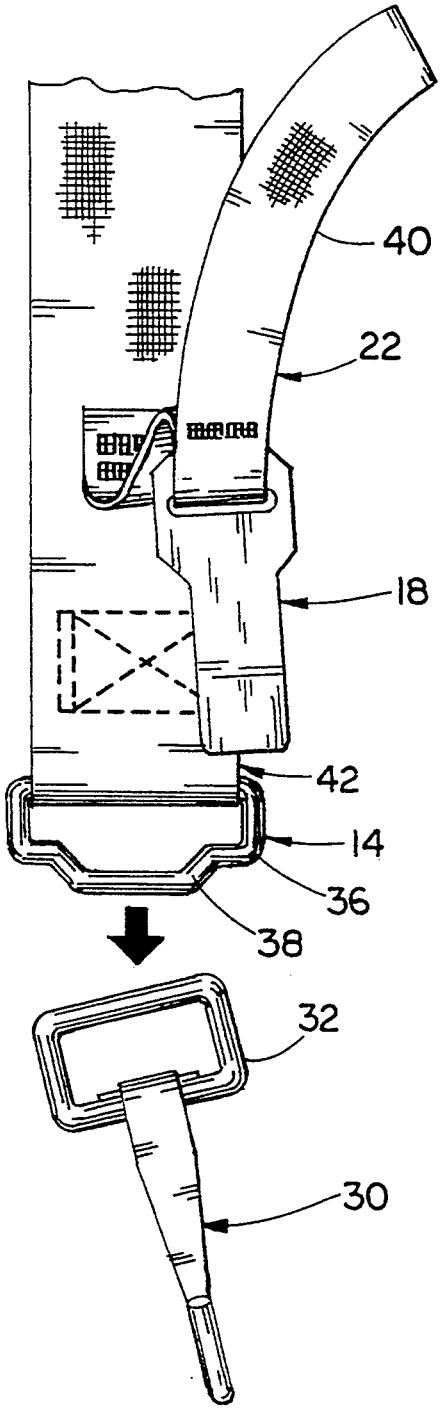
FIG. 4 is a detailed front view of the present invention with its tang released and a detachable snaphook disengaging from a harness.

In FIG. 4, the collar 14 is pivoted downward, through gravitational force, to a normal release position toward the back face (not shown) of the harness 42. In the normal release position, the collar 14 is aligned along substantially the same plane as the harness 42. In this position, as shown in FIG. 4, the detachable snaphook 30 is automatically disengaged from the collar 14.

In the present invention, the collar 14 is a substantially C-shaped frame 36 connected at a 107° angle to a substantially U-shaped frame 38 of smaller diameter. For optimum operation, the angle of connection should be between 75° and 135°. The substantially U-shaped frame 38 provides the overbalance needed to rotate the collar 14, through gravitational forces, downward to its normal release position. The same gravitational effect is achieved when the diameter of the substantially U-shaped frame 38 equals the diameter of the substantially C-shaped frame 36.

In an alternate embodiment, the collar 14 is substantially rectangular in shape. The gravitational effect is achieved when the weight of the attached segment is less than the weight of the unattached, parallel segment. The additional weight provides the overbalance needed to rotate the collar 14, through gravitational forces, downward to its normal release position.

During disconnection, the operator pulls the free end 40 of the cord 22. As the tang 18 clears the slot 34, the collar 14 rotates downward under gravitational forces to its normal release position. The yoke 32 of the detachable snaphook clamp 30 automatically disengages from the collar 14 and the harness 42 is released from the equipment.

While this invention has been explained with reference to the structure disclosed herein, it is not confined to the details set forth and this application is intended to cover any modifications and changes as may come within the scope of the following claims:

What is claimed is:

1. A quick release disconnect for a harness comprising an attached pivotable collar pulled through gravitational force from a lock position of upward rotation into a normal release position of downward rotation, a detachable snaphook having an attached yoke, the pivotable collar in its lock position of upward rotation engaging the yoke, a tang for securing the pivotable collar in its lock position to the yoke, and a flexible quick-release means for detaching the tang from the pivotable collar such that the pivotable collar returns to its normal release position and the yoke is automatically disengaged from the pivotable collar.

2. The quick release disconnect of claim 1 wherein the quick-release means is fastened to the tang and a harness.

3. The quick release disconnect of claim 1 wherein the yoke is substantially rectangular in shape.

4. The quick release disconnect of claim 1 wherein the collar comprises a substantially C-shaped frame and a substantially U-shaped frame connected at a 107° angle at their respective openings.

5. The quick release disconnect of claim 4 wherein the angle is between 75° and 135°.

6. The quick release disconnect of claim 1 wherein the collar is substantially rectangular.

* * * * *